US006688229B2

(12) United States Patent
Eisele et al.

(10) Patent No.: US 6,688,229 B2
(45) Date of Patent: Feb. 10, 2004

(54) METHOD FOR CONTROLLING A PRINTING PROCESS

(75) Inventors: Peter Eisele, Östringen (DE); Andreas Forer, Heidelberg (DE); Rainer Ihle, Bammental (DE); Michael Kaiser, Heidelberg (DE); Stefan Schenk, Bammental (DE); Gerhard Schlindwein, Graben-Neudorf (DE); Mathias Supp, Au Am Rhein (DE); Volker Weidner, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/859,793

(22) Filed: May 17, 2001

(65) Prior Publication Data

US 2002/0002923 A1 Jan. 10, 2002

(30) Foreign Application Priority Data

May 17, 2000 (DE) ..... 100 23 945

(51) Int. Cl.[7] ..... B41F 1/54

(52) U.S. Cl. ..... 101/483; 101/484; 400/61; 400/70; 400/76

(58) Field of Search ..... 101/483, 484, 101/485, 486; 400/61, 67, 68, 70, 76

(56) References Cited

U.S. PATENT DOCUMENTS

| | | | | | |
|---|---|---|---|---|---|
| 5,365,847 | A | * | 11/1994 | Pers | 101/248 |
| 5,806,430 | A | * | 9/1998 | Rodi | 101/484 |
| 5,828,814 | A | * | 10/1998 | Cyman et al. | 395/102 |
| 5,963,968 | A | * | 10/1999 | Warmus et al. | 715/517 |
| 6,012,070 | A | * | 1/2000 | Cheng et al. | 715/505 |
| 6,029,576 | A | * | 2/2000 | Fischer et al. | 101/485 |
| 6,196,670 | B1 | * | 3/2001 | Saruta | 347/86 |
| 6,230,622 | B1 | * | 5/2001 | Dilling | 101/484 |
| 6,256,108 | B1 | * | 7/2001 | Dziesietnik et al. | 358/1.18 |
| 6,327,599 | B1 | * | 12/2001 | Warmus et al. | 715/517 |
| 6,332,149 | B1 | * | 12/2001 | Warmus et al. | 715/517 |
| 6,441,920 | B1 | * | 8/2002 | Smith | 358/1.2 |
| 6,446,100 | B1 | * | 9/2002 | Warmus et al. | 715/517 |
| 6,519,048 | B1 | * | 2/2003 | Tanaka | 358/1.13 |
| 6,519,050 | B1 | * | 2/2003 | Eintracht et al. | 358/1.15 |
| 2002/0032694 | A1 | * | 3/2002 | Zawadzki et al. | 707/500 |

FOREIGN PATENT DOCUMENTS

| | | | |
|---|---|---|---|
| DE | 195 33 811 A1 | | 3/1997 |
| DE | 197 17 144 A1 | | 10/1998 |
| DE | 198 44 495 A1 | | 4/2000 |
| EP | 0 878 303 A2 | | 11/1998 |
| JP | 411300937 A | * | 11/1999 |
| JP | 02001158082 A | * | 6/2001 |

OTHER PUBLICATIONS

"Die vernetzte Druckerei" (The Networked Printing Press), KBA Opera Network at drupa 2000, No. 4.

"Elektronisches Ausschieβen im RIP von PDF–und TIF-F–IT–Datei" (Electronic Imposing in RIP of PDF–and TIF-F–IT Files), FOGRA–Information, No. 156.

"Neues PDF–Workflow–System für die offene Druck-vorstufe" (New PDF–Workflow–System for the new Pre–Press Stage), German Press, No. 34, Sep. 1999.

"Bogenmontageprogramme für die digitale Druckvorstufe" (Sheet Mounting Programs for the Digital Pre–Press Stage), Druckspiegel, Jan. 1998.

"Neue Dienstleistungen: Vom Druck–zum Medienhaus" (New Services: From the Printing to the Media (Theiss), German Press, No. 22, 1999.

* cited by examiner

*Primary Examiner*—Charles H. Nolan, Jr.
(74) *Attorney, Agent, or Firm*—Laurence A. Greenberg; Werner H. Stemer; Ralph E. Locher

(57) ABSTRACT

A method for printing includes a plurality of process steps. According to an additional step, relevant data are stored in a central relational database. Both a printing press and a data processing unit processing prepress data are interconnected.

4 Claims, 2 Drawing Sheets

METHOD FOR CONTROLLING A PRINTING PROCESS

BACKGROUND OF THE INVENTION

Field of the Invention

The invention relates to a method for controlling a printing process, in particular an offset printing process, wherein prepress data are generated and are then supplied to a data processing unit, in particular a Raster Image Processor (RIP), and then to a printing press.

Today, the printing process usually begins at a prepress stage, where an original image to be printed is created. In several following process steps, that original image is used to produce a required number of printing plates. According to conventional printing processes, that means that color separations are created, which are then used to produce a printing form. The prepared printing forms are then positioned in the printing press and used for printing. The printing press is connected to a control unit for monitoring the printing press and for inputting data relating to a print job.

If the printing forms are produced digitally, the prepress data are supplied to a data processing unit known as a Raster Image Processor, which converts the data into a bitmap. The bitmap is then used to image the printing plates either directly in the printing press or in a separate imaging apparatus. If necessary, the plates containing the image to be printed are then positioned in the printing press and the printing operation, which is controlled through a printing press control unit, is started.

However, a disadvantage of the system described above is that a manual combination of the data present in the RIP and the data present in the printing press, in particular the data relating to the print job, presents considerable difficulties. Such a combination of data even becomes impossible if the print job is formed of several printing operations, since the data of the individual printing operations cannot be combined. In such a case, an automatic reevaluation of the print job becomes impossible.

SUMMARY OF THE INVENTION

It is accordingly an object of the invention to provide a method for controlling a printing process, which overcomes the hereinafore-mentioned disadvantages of the heretofore-known methods of this general type, which provides better control over a print job to be executed and which offers an opportunity of re-evaluating the print job.

With the foregoing and other objects in view there is provided, in accordance with the invention, a method for controlling a printing process, in particular an offset printing process. The method comprises transferring data to a data processing unit, in particular a Raster Image Processor, storing the data in a database for relational linking among the data received by the database, and subsequently transferring the data to a printing press. The data transfer step is carried out either directly from the database to the printing press or from the database, through the data processing unit, to the printing press.

In accordance with a concomitant mode of the invention, the method further comprises supplying the database with data relating to a print job by a print job unit.

According to the invention, a database is provided which relationally combines the received data in such a way that the prepress data and the data that has been input into the printing press can be combined so that a universal re-evaluation of the data becomes possible. Therefore, an automatic re-calculation process may be initiated on the basis of the data stored in the database.

Other features which are considered as characteristic for the invention are set forth in the appended claims.

Although the invention is illustrated and described herein as embodied in a method for controlling a printing process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
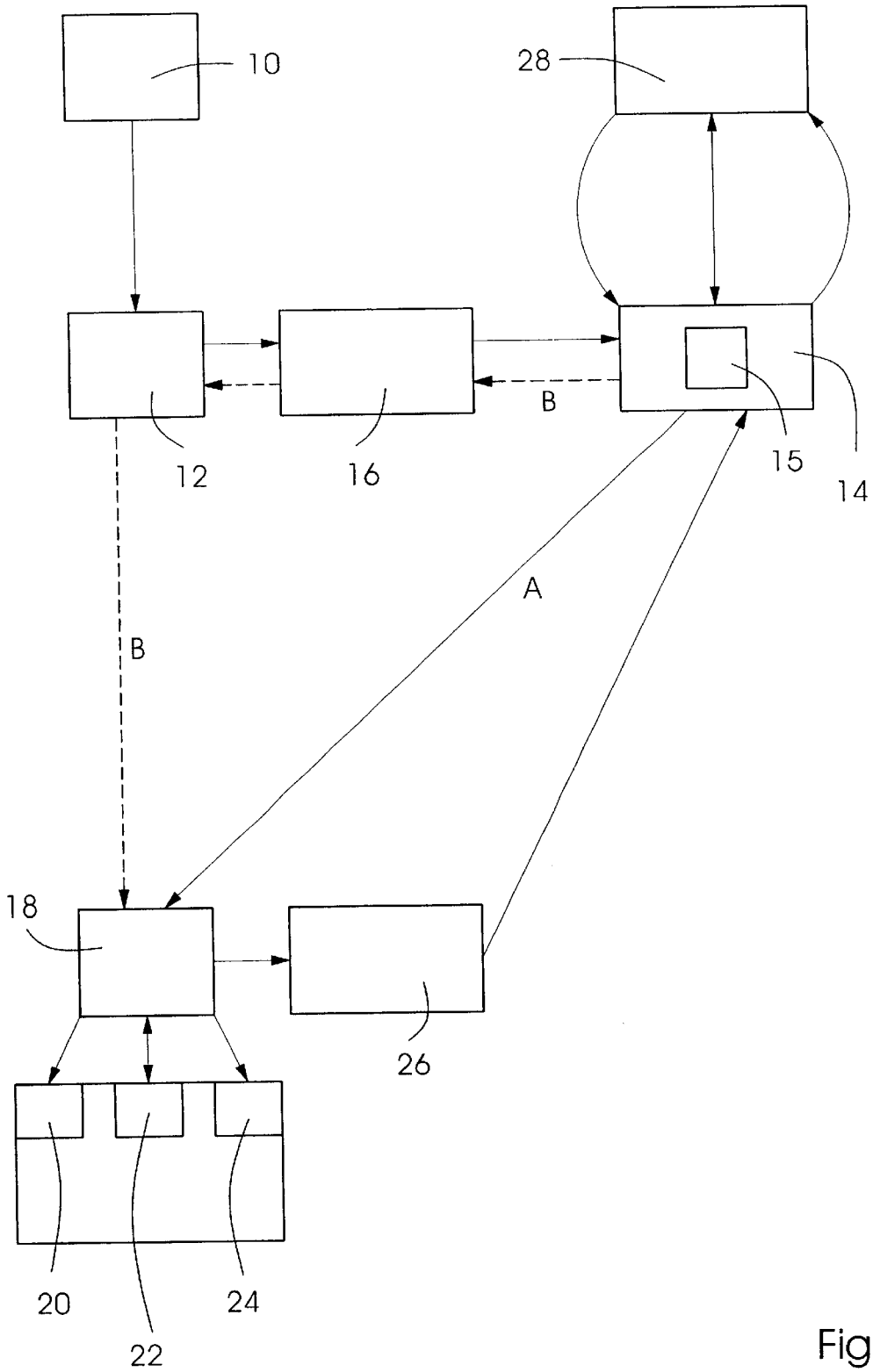
FIG. 1 is a flow chart of a first method according to the invention.

Referring now to the figures of the drawings in detail and first, particularly, to FIG. 1 thereof, there is seen a prepress stage 10 where image data required for a printing process are generated. In most cases, the prepress data are prepared in the form of Postscript or PDF files. The Postscript or PDF file is supplied to a RIP 12, which converts the Postscript or PDF data into what is known as a bitmap for each of the required color separations. If a direct imaging press is used, the bitmap files may be supplied to the press to be used for imaging the plate in the press. According to the invention, an additional unit 14 is provided before the bitmap files are transmitted to the printing press. A substantial component or the only component of the additional unit 14 is a database 15, in which data received from the RIP 12 are stored. The database is able to create a relational link between all of the incoming data. The data coming from the RIP may, for example, contain an ID number, a document name, a bitmap name, a processing time for the RIP or other information relevant for the RIP. The data coming from the RIP 12 are preferably supplied to the additional unit 14 through an RIP event processing unit 16. The RIP event processing unit 16 processes the data coming from the RIP 12 in such a way that only the data which will later be required for the printing press are stored. In this respect, the RIP event processing unit 16 acts as a data filtering logic for filtering certain data between the RIP 12 and the database 15 according to a definitely predetermined or variable logic. What is forwarded is, in particular, the name of the document or information concerning the RIP processing data. Data which are redundant or irrelevant for the printing press operation to be carried out later will not be forwarded. Among the data not to be forwarded is what is known as intermediate status information, such as the size of the generated bitmap in pixels.

There are several options for extracting the data which are relevant for the printing process and are consequently to be stored in the database of the additional unit 14. A first option is that the RIP event processing unit 16 continuously receives information on the current state of the RIP. Upon an end signal indicating the end of the RIP processing operation, the RIP event processing unit 16 receives an information signal indicating that the job has been completed. Afterwards, all operational data are stored in the database 15, which may create a relational link between the data. A second option is that the operational data are continuously held in a file in the RIP event processing unit 16, in particular in what is known as a "logfile". This file is continuously analyzed to provide an analysis of the relevant information according to the logic stored in the RIP event processing device 16 and to store the relevant information in the database 15.

The data stored in the database 15 may then be fed to a printing press, in particular to a direct imaging printing press. The data may be transferred to the press along a direct path A or along an indirect path B indicated in dashed lines, i.e. through the RIP.

A printing press 18 may also include additional units such as a device 20 for regulating ink keys, an imaging device 24 and a device 22 for controlling the press. The latter may also include a device for obtaining operational data.

Further operational data, for example concerning the actual number of correctly printed sheets, the number of spoiled sheets, the required set-up time, the duration of the print run etc., are obtained during the print run. These operational data may be obtained automatically, may be provided by an external source or may be input by a press operator. The operational data are then fed to a print event processing unit 26, where they are analyzed and processed, if necessary, and then forwarded to the database 15 of the additional unit 14.

The data in total, i.e. both the operational data and the RIP data contained in the relational database, may be accessed through an external module 28, by providing the database 15 according to the invention. This provides a number of evaluation options as well as the option to introduce external information into the database 15.

Although the additional unit 14 and the database 15 are shown as individual components in FIG. 1, it is to be understood that the two components may of course be combined to form only one individual component being formed of the additional unit 14 and the database 15.

Figure 2:
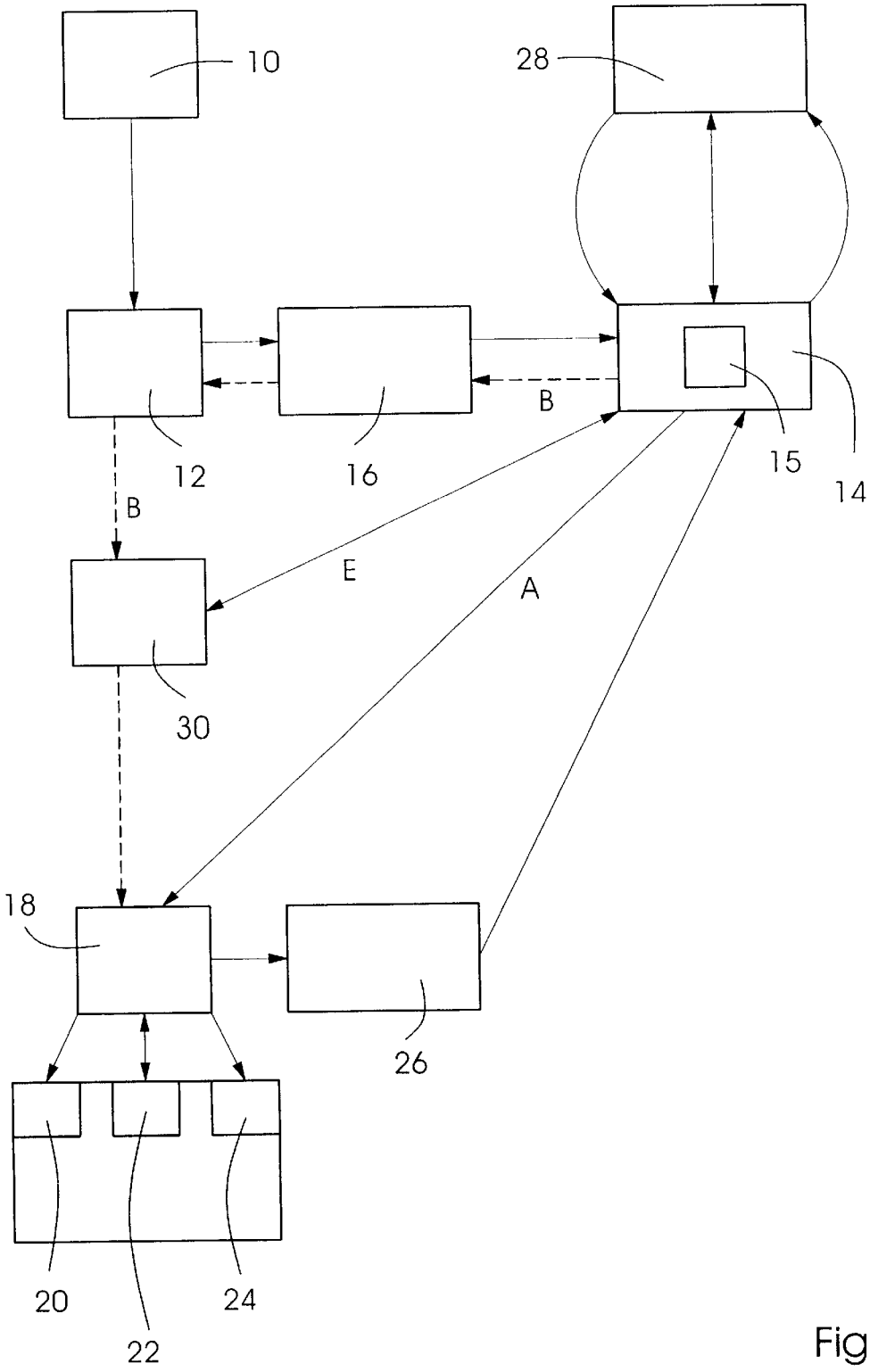
FIG. 2 is a flow chart of a second method according to the invention including a job allocation.

In the embodiment of the invention shown in FIG. 2, a further step is added to the method according to the invention. As soon as the respective data have been converted into bitmaps in the RIP, the bitmaps are stored in a specific index in the file 15. This index is continuously monitored by an input and print job unit 30. As soon as a new bitmap has been stored in the file 15, a corresponding signal is forwarded to the print job unit 30 and displayed on a suitable display device such as a monitor. Then the press operator may be asked to input the relevant job data relating to this bitmap through a suitable program. It is to be understood that these data may be newly input, or a suitable job may be selected from a list of already existing jobs. After this step has been completed, the job is confirmed and the necessary links are entered in the relational database 15. This ensures an automatic allocation of all files to this job. In addition, the data relating to the job, such as the number of products to be produced, recto/verso printing, printing stock etc., are written in a file which belongs to the data set and which may be read at the printing press.

Thus, there is a bi-directional connection E between the relational database 15 and the print job unit 30.

As described in the context of FIG. 1, the relevant contents of the relational database 15 may be forwarded to the printing press along the direct path A or along the indirect path B indicated by the dashed line, i.e., for example, through the RIP 12.

We claim:

1. A method for controlling a printing process, which comprises:

processing image data in a raster image processor (RIP) for generating processed image data;

filtering operational data from the processed image data in a raster image processor (RIP) event processing unit;

storing the operational data in a database;

inputting job data into the database via an input and print job unit;

logically interconnecting the operational data with the job data for generating logically interconnected data; and transferring the logically interconnected data from the database to a printing machine.

2. The method according to claim 1, which further comprises carrying out the step of transferring the logically interconnected data directly from the database to the printing press.

3. The method according to claim 1, which further comprises carrying out the step of transferring the logically interconnected data from the database, through the raster image processor (RIP), to the printing press.

4. The method according to claim 1, which further comprises supplying the database with data relating to a print job by a print job unit.

* * * * *